United States Patent [19]

Saul et al.

[11] Patent Number: 4,517,556

[45] Date of Patent: May 14, 1985

[54] AUTOMATIC BYPASS SWITCH FOR HOUSEHOLD SECURITY SYSTEM

[75] Inventors: Ben Saul, Montreal; Doug Hartley, Dollard des Ormeaux, both of Canada

[73] Assignee: Sur-Gard Security Systems Ltd., Montreal, Canada

[21] Appl. No.: 452,509

[22] Filed: Dec. 23, 1982

[51] Int. Cl.³ ..... G08B 23/00

[52] U.S. Cl. ..... 340/528; 340/527; 340/532

[58] Field of Search ..... 340/528, 527, 526, 521, 340/522, 523, 532, 500, 506, 541

[56] References Cited

U.S. PATENT DOCUMENTS

| | | | |
|---|---|---|---|
| 3,594,768 | 7/1971 | Harris | 340/528 |
| 4,188,621 | 2/1980 | Heckelman et al. | 340/528 |
| 4,427,975 | 1/1984 | Kinzie | 340/528 |

*Primary Examiner*—Donnie L. Crosland

[57] ABSTRACT

An automatic bypass switch comprising an electronic switch circuit responsive to voltage signals generated by the delay circuit and armed status of an electronic alarm system. The output of the bypass switch is connected to one or more detection circuits so as to shunt or prevent activation when the control has been armed until the delay circuit has been activated. From this time until the panel has been disarmed and rearmed again, the controlled detection circuit(s) is active and not shunted.

10 Claims, 1 Drawing Figure

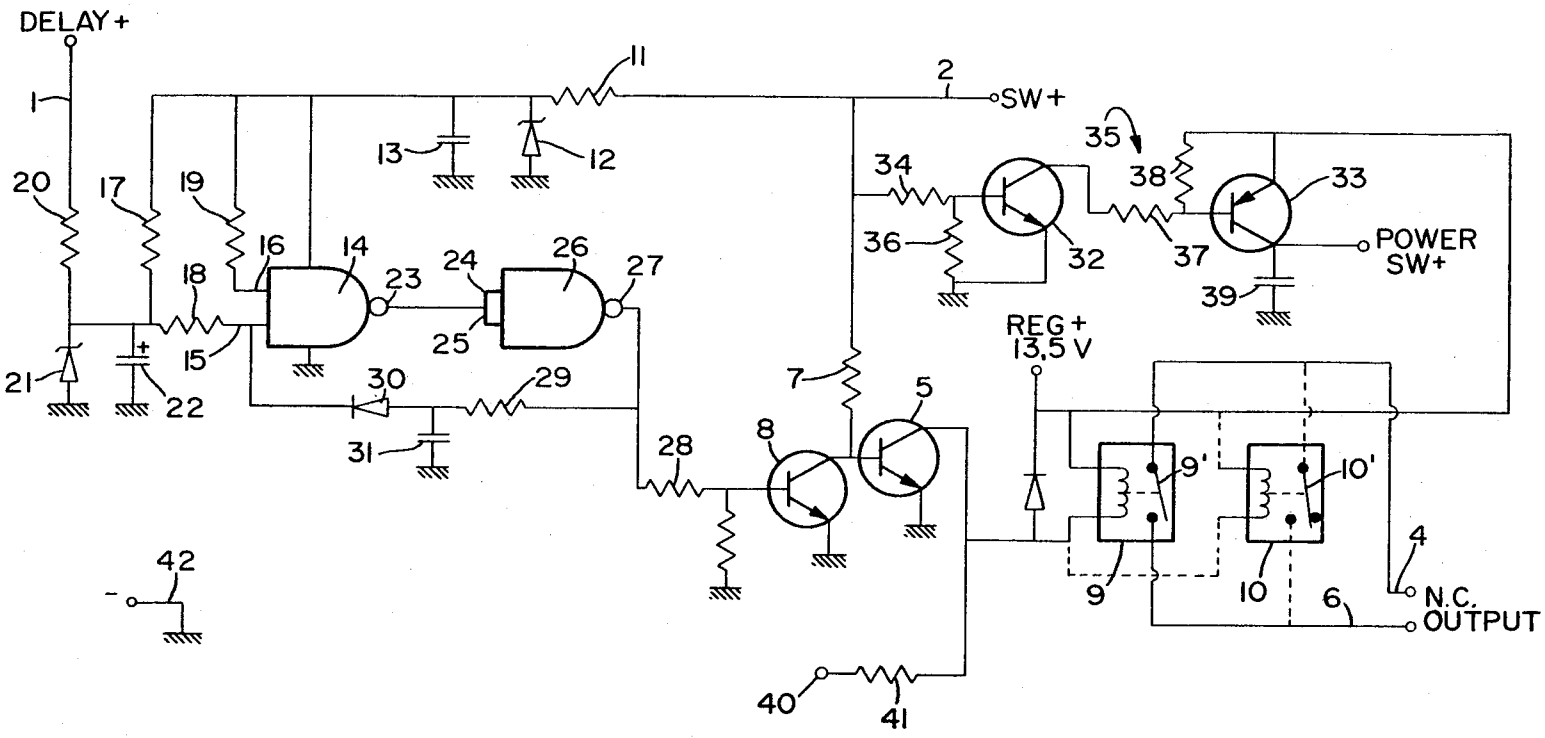
DELAY+
SW+
POWER SW+
N.C. OUTPUT
REG+ 13.5 V
1
2
4
5
6
7
8
9
9'
10
10'
11
12
13
14
15
16
17
18
19
20
21
22
23
24
25
26
27
28
29
30
31
32
33
34
35
36
37
38
39
40
41
42

AUTOMATIC BYPASS SWITCH FOR HOUSEHOLD SECURITY SYSTEM

BACKGROUND OF INVENTION (a) Field of Invention

The present invention relates to additional circuitry for a security alarm system embodying an electronic switch capable of sensing that the user is leaving the premises to be protected and accordingly activating the interior protection detection circuit or circuits.

(b) Description of Prior Art

To date, security (intrusion) alarm systems use manual switch means to deactivate interior protection such as ultrasonic, microwave or passive infrared motion detectors, while the user is inside and wants perimeter protection. A manual bypass switch shunting a zone of protection, and an extra code number to operate on a digital key pad arming station are examples of methods now in use. These existing methods require time and thought on the part of the user. When forgotten, a false alarm or a reduction in level of protection may result. Extra wiring to remote arming stations is required on some systems to connect manual bypassing.

SUMMARY OF INVENTION

It is a feature of the present invention to thereby provide an electronic switch circuit connected to a security alarm system which substantially obviates all the above-mentioned disadvantages.

Another feature of the present invention is to provide an automatic control of the active/shunted status of one or more instant circuits by the door contact or other detection device(s) on the delay circuit of the electronic alarm system. This greatly simplifies the operation of the system and makes it more practical to provide protection while the user is inside the protected premises.

Another feature of the present invention is that during the time that the system is disarmed (off), the bypassing is not in effect and the instant circuit is active. This means that alarm signals from the detection devices will indicate on loop status light(s) so the user can test these devices and also know that they have set up in the normal non-alarm state before arming the system.

According to the above features, from a broad aspect, the present invention provides an automatic electronic switch circuit for use with an electronic alarm system having intrusion detection means. Means is provided to arm or disarm said system. The alarm system has a delay circuit to safely identify intrusion after a time delay during which the user arms the system and vacates an area to be protected through a closure member. The switch circuit comprises a first switch circuit connected to a first input to sense when the system is armed or disarmed. A second switch circuit is connected to a second input to which the delay circuit is also connected to sense when the delay circuit is closed or open. Switch means is connected to the first and second switch circuit to activate or deactivate the detection means dependent on the condition of the first and second switch circuits. An alarm state sensing circuit is connected to the second switch circuit to condition the switch means to operate upon receiving a positive signal from the first switch circuit that the area has been vacated through the closure member.

BRIEF DESCRIPTION OF DRAWINGS

A preferred embodiment of the present invention will now be described with reference to the accompanying drawing which is a schematic diagram of the automatic bypass switch of the present invention.

The electronic switch circuit of the invention illustrated in the drawing was conceived to be connected in electronic alarm systems and to operate automatically to ensure that the alarm system is "idiot proof" and automatically armed when the user vacates the area protected by the system. Such electronic alarm systems that can incorporate this electronic switch is exemplified by reference to U.S. copending application Ser. No. 372,069 filed on Apr. 26, 1982.

DESCRIPTION OF PREFERRED EMBODIMENTS

The output connections herein marked as 4 and 6 "N.C. output", are connected across a normally closed detection circuit (not shown) of an electronic alarm system (not shown) containing the motion detectors or other detection means to be bypassed. The two inputs are identified by numeral 1, "Delay+", and numeral 2 "SW+". The input 1 feeds a signal to the automatic bypass switch to indicate the state of a delay loop of an alarm system (not shown). With this embodiment, the delay circuit closed loop of the alarm system (not shown) holds input 1 to negative (low) normally. There is a positive voltage applied to input 1 from the positive side of the delay loop and also internally when that loop is broken, as when the entry/exit door of an area to be protected is opened.

The input 2 feeds a signal to the automatic bypass switch indicating that the alarm system is armed. With this embodiment, there is a positive voltage applied to input 2 only when the system is armed, referred to as "switched plus" "SW+".

Switched plus voltage on input 2 is applied to the base of transistor 5 through resistor 7. Provided that conditioning transistor 8 is off, transistor 5 will be on, energizing the coil of the output relay 9 or 10, whichever type was installed on a particular detection circuit. This closes the normally open relay contacts 9' or 10', effecting the bypass of the detection means (not shown) of the detection circuit through output connections 4 and 6. Whenever there is no SW+ voltage applied to input 2, when the system is disarmed, transistor 5 will be "off". The output relay 9 or 10 deenergized, and the output contacts 9' or 10' will be open and not bypassing. The SW+ voltage at input 2 is also applied to resistor 11, Zener diode 12, and capacitor 13 to provide a filtered, regulated voltage of about 10 volts. This regulated voltage powers quad NAND gate integrated circuit 14 and applies a logic 1 (high) to the two inputs 15 and 16 of circuit 14 through resistors 17–18 and 19. When the delay loop (not shown) of the alarm system is normal or closed, resistors 17 and 20 form a voltage divider which brings the voltage at input 15 of circuit 14 to the logic 0 (low) level. Zener diode 21 and capacitor 22 provide transient and static protection for input 15. With input 15 low, the output 23 is high. This high level applied to both inputs 24 and 25 of gate 26 results in a low at output 27. With a low applied to the base of transistor 8 through resistor 28, transistor 8 is off, allowing transistor 5 to be on and the relay output to be in the closed bypass condition.

If the delay circuit is then opened, as when someone arms the panel and then opens the door to leave within a predetermined time delay of the system, then resistor 20 will no longer pull down input 15 of circuit 14, which now goes high. This results in a high at output 27 through the connections described above. This high is applied back to input 15 through resistor 29 and diode 30 to latch this condition for after the door is closed again. Capacitor 31 adds noise immunity to this latching circuit. The high output of approximately 10 volts from output 27 is applied to transistor 8 through resistor 28. This switches on transistor 8 and turns off transistor 5. Then the output relay 9 or 10 is deenergized and the contacts 9'–10' open, removing the bypass so that the interior protection can be active while no one is inside the protected premises.

A power SW+ circuit consisting of transistors 32 and 33 and associated resistors 34, 36, 37 and 38, and capacitor 39 may be provided as an additional convenience. This power SW+ circuit 35 allows motion detectors and other devices to be powered only when the system is armed, if so desired. Also, a pilot lamp (not shown) may be light when the relay 9 or 10 is energized and output connection 40 through resistor 41 is provided for this use. Numeral 42 designated the ground connection for the switch circuit.

It is within the ambit of the present application to provide any obvious modifications of the circuit described herein, provided such modifications fall within the scope of the broadest claim herein.

We claim:

1. An automatic electronic switch circuit for use with an electronic alarm system having intrusion detection means, means to arm or disarm said system, said alarm system having a delay circuit to safely identify intrusion after a time delay during which the user arms the system and vacates an area to be protected through a closure member, said switch circuit comprising a first switch circuit connected to a first input to sense when said system is armed or disarmed, a second switch circuit connected to a second input to which said delay circuit is also connected to sense when said delay circuit is closed or open, switch means connected to said first and second switch circuits for activating or deactivating said detection means depending on the condition of said first and second switch circuits, an alarm state sensing circuit connected to said second switch circuit to condition said switch means to operate upon receiving a positive signal from said first switch circuit that said area has been vacated through said closure member.

2. A switch circuit as claimed in claim 1 wherein said switch means comprises a switching transistor having its output connected to a relay coil having a switch contact which when closed deactivates said detection means and when open activates said detection means.

3. A switch circuit as claimed in claim 2 wherein said alarm state sensing circuit comprises a voltage quad NAND gate integrated circuit having a first and second input connection and an output connection, said output connection controlling the state of said switching transistor whereby said switching transistor may be operative when said delay circuit is normal (closed) and inoperative when said delay circuit is broken (open) placing said switching transistor in an operative state when receiving a voltage signal from said first switch circuit.

4. A switch circuit as claimed in claim 3 wherein said output connection of said NAND gate integrated circuit is connected to dual inputs of a further gate having its output connection connected to the base of a conditioning transistor whose collector controls the base of said switching transistor, said conditioning transistor when operative causing said switching transistor to be inoperative, and a latching circuit connected between the output connection of said gate to said second input connection of said NAND gate integrated circuit.

5. A switch circuit as claimed in claim 4 wherein said second input connection of said NAND gate integrated circuit is connected to said second input of said second switch circuit, said first and second input connection of said NAND gate also being connected to said first input of said first switch circuit.

6. A switch circuit as claimed in claim 5 wherein when said alarm system is armed a positive voltage signal is applied to said first input of said first switch circuit and applied to the base of said switching transistor and both input and output connections of said NAND gate integrated circuit to power same, when said delay circuit is normal the voltage at said second input connection of said NAND gate will be low (logic 0) making the output connection high resulting in the output connection of said further gate to be low and thus switching off said conditioning transistor allowing said switching transistor to be operative and the relay contacts to be closed and bypassing said detection means.

7. A switch circuit as claimed in claim 4 wherein said latching circuit comprises a resistor and diode connected in series between said NAND gate integrated circuit output and its second input connection, and a capacitor connected intermediate said resistor and diode and ground to add noise immunity to said latching circuit.

8. A switch circuit as claimed in claim 4 wherein said second input connection of said NAND gate integrated circuit is provided with transient and static protection by means of a Zener diode and capacitor connected to a resistor to said first input of said first switch circuit and ground, said resistor and another resistor connected to said first input connection of said NAND gate forming a voltage divider circuit to bring the voltage at said first and second input connections of said NAND gate to a low level.

9. A switch circuit as claimed in claim 8 wherein a voltage regulator is provided by a transistor connected at one end to said first input of said first switch circuit and at another end to a parallel array of a Zener diode and capacitor having their opposed ends grounded, said other end also being connected to said another resistor.

10. A switch circuit as claimed in claim 4 wherein there is further provided a power switch voltage supply to allow said detection means to be powered only when said system is armed, said detection means comprising motion detectors such as ultrasonic, microwave or passive infrared motion detectors or other suitable detection means.

* * * * *